US010945071B1

(12) United States Patent
Long et al.

(10) Patent No.: US 10,945,071 B1
(45) Date of Patent: Mar. 9, 2021

(54) SOUND COLLECTING METHOD, DEVICE AND MEDIUM

(71) Applicant: BEIJING XIAOMI MOBILE SOFTWARE CO., LTD., Beijing (CN)

(72) Inventors: Taochen Long, Beijing (CN); Haining Hou, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 16/699,058

(22) Filed: Nov. 28, 2019

(30) Foreign Application Priority Data

Aug. 15, 2019 (CN) ..... 201910754717.8

(51) Int. Cl.
*H04R 3/00* (2006.01)
*H04R 1/40* (2006.01)
*H04R 1/04* (2006.01)

(52) U.S. Cl.
CPC ..... *H04R 3/005* (2013.01); *H04R 1/04* (2013.01); *H04R 1/406* (2013.01); *H04R 2499/11* (2013.01)

(58) Field of Classification Search
None
See application file for complete search history.

(56) References Cited

U.S. PATENT DOCUMENTS 8,712,059 B2 4/2014 Del Galdo et al.
2008/0004729 A1 1/2008 Hiipakka
2008/0170718 A1 7/2008 Faller
2009/0097670 A1 4/2009 Jeong et al.
2014/0286497 A1* 9/2014 Thyssen ..... H04R 3/005 381/66
2015/0156578 A1* 6/2015 Alexandridis ..... H04R 3/005 381/92

(Continued)

FOREIGN PATENT DOCUMENTS

CN 104766093 A 7/2015
CN 105590631 A 5/2016

(Continued)

OTHER PUBLICATIONS

International Search Report of PCT Application No. PCT/CN2019/111322 dated May 13, 2020.

(Continued)

*Primary Examiner* — Qin Zhu
(74) *Attorney, Agent, or Firm* — Syncoda LLC; Feng Ma

(57) ABSTRACT

A method for sound collection includes: converting time domain signals with a number of M collected by devices for sound collecting with a number of M into original frequency domain signals with a number of M; performing beam-forming on the M original frequency domain signals at each of preset grid points, to obtain beam-forming frequency domain signals with a number of N in one-to-one correspondence with the preset grid points; determining an average amplitude of frequency components with a number of N corresponding to each of frequency points with a number of K based on the beam-forming frequency domain signals with a number of N, and synthesizing a synthesized frequency domain signal including the frequency points and having an average amplitude as an amplitude at the each of the frequency points with a number of K; and converting the synthesized frequency domain signal into a synthesized time domain signal.

20 Claims, 4 Drawing Sheets

(56) References Cited

U.S. PATENT DOCUMENTS

| | | | | |
|---|---|---|---|---|
| 2016/0217803 | A1* | 7/2016 | Sugiyama | G10L 21/0388 |
| 2020/0145752 | A1* | 5/2020 | Janse | H04R 1/406 |
| 2020/0154200 | A1* | 5/2020 | McCowan | H04R 1/406 |

FOREIGN PATENT DOCUMENTS

| | | | |
|---|---|---|---|
| CN | 106710601 | A | 5/2017 |
| CN | 107017000 | A | 8/2017 |
| CN | 109036450 | A | 12/2018 |
| JP | 2018056902 | A | 4/2018 |
| KR | 20040094300 | A | 11/2004 |
| KR | 20190016683 | A | 2/2019 |
| WO | 2011027337 | A1 | 3/2011 |

OTHER PUBLICATIONS

First Office Action and Search Report of Russian Application No. 2019141085 dated Apr. 17, 2020.

Extended European Search Report in Application No. 19218101, dated Aug. 3, 2020.

Compression Computational Grid Based on Functional Beamforming for Acoustic Source Localization; Wei Ma, Xun Liu, Applied Acoustics 134 (2018) 75-87.

Grid-free Compressive Beamforming; Angeliki Xenaki, Peter Gerstoft, J. Acoust. Soc. Am. 137(4), pp. 1923-1935, Apr. 2015.

Geometric Source Separation: Merging Convolutive Source Separation With Geometries Beamforming, Lucas C. Parra and Christopher V. Alvino, IEEE Transactions on Speech and Audio Processing, vol. 10, No. 6, Sep. 2002.

Shengkui Zhao et al., Frequency-domain beamformers using conjugate gradient techniques for speech enhancement, The Journal of the Accoustical Society of America 136, 1160 (2014).

Lin Wang et al., Combining Superdirective Beamforming and Frequency-Domain Blind Source Separation for Highly Reverberant Signals, Hindawi Publishing Corporation, EURASIP Journal on Audio, Speech, and Music Processing, vol. 2010, Aritical ID 797962, 13 pages.

* cited by examiner

SOUND COLLECTING METHOD, DEVICE AND MEDIUM

CROSS-REFERENCE TO RELATED APPLICATION

This application claims priority to Chinese Patent Application 201910754717.8 filed on Aug. 15, 2019, the disclosure of which is hereby incorporated by reference in its entirety.

BACKGROUND

In the era of Internet of Things (IoT) and Artificial Intelligence (AI), intelligent voice, as one of core technologies of artificial intelligence, may effectively improve a mode of human-computer interaction and greatly improve convenience of using smart products.

SUMMARY

The present disclosure relates to the field of sound collecting, particularly to a method for sound collecting, device and medium.

According to a first aspect of embodiments of the present disclosure, there is provided a method for sound collecting, including:

converting time domain signals with a number of M collected by devices for sound collecting with a number of M into original frequency domain signals with a number of M;

performing beam-forming on the original frequency domain signals with a number of M at each of preset grid points with a number of N, to obtain beam-forming frequency domain signals with a number of N in one-to-one correspondence with the preset grid points with a number of N;

determining, based on the beam-forming frequency domain signals with a number of N, an average amplitude of frequency components with a number of N corresponding to each of frequency points with a number of K and synthesizing a synthesized frequency domain signal including the frequency points with a number of K and having the average amplitude as an amplitude at each of the frequency points with a number of K, wherein a phase of the synthesized frequency domain signal at each of the frequency points with a number of K is a corresponding phase in an original frequency domain signal of a reference device for sound collecting specified from the devices for sound collecting with a number of M; and converting the synthesized frequency domain signal into a synthesized time domain signal, wherein, M, N, and K are integers greater than or equal to 2.

The performing beam-forming on the original frequency domain signals with a number of M at each of the preset grid points with a number of N, to obtain the beam-forming frequency domain signals with a number of N in one-to-one correspondence with the preset grid points with a number of N includes:

selecting preset grid points with a number of N in different directions within a desired collecting range of the devices for sound collecting with a number of M;

determining a steering vector associated with each of the frequency points with a number of K based on a positional relationship between the devices for sound collecting with a number of M and each of the preset grid points with a number of N at the each of the preset grid points with a number of N; and performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N.

Determining the steering vector associated with the each of the frequency points with a number of K based on the positional relationship between the devices for sound collecting with a number of M and the each of the preset grid points with a number of N at each of the preset grid points with a number of N includes:

obtaining a distance vector of the each of the preset grid points with a number of N to the devices for sound collecting with a number of M;

determining a reference delay vector of the each of the preset grid points with a number of N to the devices for sound collecting with a number of M based on the distance vector of the each of the preset grid points with a number of N to the devices for sound collecting with a number of M and a distance from the each of the preset grid points with a number of N to a reference device for sound collecting; and determining the steering vector of the each of the preset grid points with a number of N at the each of the frequency points with a number of K based on the reference delay vector.

Performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N includes:

determining a beam-forming weight coefficient corresponding to the each of the frequency points with a number of K based on the steering vector of the each of the frequency points with a number of K and a noise covariance matrix of the each of the frequency points with a number of K; and determining the beam-forming frequency domain signals corresponding to the each of the preset grid points with a number of N, based on the beam-forming weight coefficient and the original frequency domain signals with a number of M.

The preset grid points with a number of N are evenly arranged on a circle in a horizontal plane of an array coordinate system formed by the devices for sound collecting with a number of M.

According to a second aspect of embodiments of the present disclosure, there is provided a device for sound collecting, including: a signal converting module, configured to convert time domain signals with a number of M collected by devices for sound collecting with a number of M into original frequency domain signals with a number of M;

a signal processing module, configured to perform beam-forming on the original frequency domain signals with a number of M at each of preset grid points with a number of N, to obtain beam-forming frequency domain signals with a number of N in one-to-one correspondence with the preset grid points with a number of N;

a signal synthesizing module, configured to determine an average amplitude of frequency components with a number of N corresponding to each of frequency points with a number of K based on the beam-forming frequency domain signals with a number of N, and synthesize a synthesized frequency domain signal including the frequency points with a number of K and having the average amplitude as an amplitude at each of the frequency points with a number of K, wherein a phase of the synthesized frequency domain signal at each of the frequency points with a number of K is a corresponding phase in an original frequency domain signal of a reference device for sound collecting specified from the devices for sound collecting with a number of M; and a signal outputting module, configured to convert the synthesized frequency domain signal into a synthesized time domain signal, wherein M, N, and K are integers greater than or equal to 2.

The signal processing module performs the beam-forming on the original frequency domain signals with a number of M at each of the preset grid points with a number of N, to obtain the beam-forming frequency domain signals with a number of N in one-to-one correspondence with the preset grid points with a number of N includes:

selecting preset grid points with a number of N in different directions within a desired collecting range of the devices for sound collecting with a number of M;

determining a steering vector associated with each of the frequency points with a number of K based on a positional relationship between the devices for sound collecting with a number of M and each of the preset grid points with a number of N at the each of the preset grid points with a number of N; and performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N.

The signal processing module determines a steering vector associated with the each of the frequency points with a number of K based on the positional relationship between the devices for sound collecting with a number of M and the each of the preset grid points with a number of N at the each of the preset grid points with a number of N includes:

obtaining a distance vector of the each of the preset grid points with a number of N to the devices for sound collecting with a number of M;

determining a reference delay vector of the each of the preset grid points with a number of N to the devices for sound collecting with a number of M based on the distance vector of the each of the preset grid points with a number of N to the devices for sound collecting with a number of M and a distance from the each of the preset grid points with a number of N to a reference device for sound collecting; and determining the steering vector of the each of the preset grid points with a number of N at the each of the frequency points with a number of K based on the reference delay vector.

The performing beam-forming on the original frequency domain signals with a number of M based on the steering vector on the each of the frequency points with a number of K at the each of the preset grid points with a number of N, and obtaining the beam-forming frequency domain signals corresponding to the preset grid points with a number of N includes:

determining a beam-forming weight coefficient corresponding to the each of the frequency points with a number of K based on the steering vector of the each of the frequency points with a number of K and a noise covariance matrix of the each of the frequency points with a number of K; and determining the beam-forming frequency domain signals corresponding to the each of the preset grid points with a number of N, based on the beam-forming weight coefficient and the original frequency domain signals with a number of M.

The preset grid points with a number of N are evenly arranged on a circle in a horizontal plane of an array coordinate system formed by the devices for sound collecting with a number of M.

According to a third aspect of the embodiments of the present disclosure, there is provided a device for sound collecting, including:

a processor; and a memory configured to store processor-executable instructions, wherein the processor is configured to:

convert time domain signals with a number of M collected by devices for sound collecting with a number of M into original frequency domain signals with a number of M;

perform beam-forming on the original frequency domain signals with a number of M at each of preset grid points with a number of N, to obtain beam-forming frequency domain signals with a number of N in one-to-one correspondence with the preset grid points with a number of N;

determine an average amplitude of frequency components with a number of N corresponding to each of frequency points with a number of K based on the beam-forming frequency domain signals with a number of N, and synthesizing a synthesized frequency domain signal including the frequency points with a number of K and having the average amplitude as an amplitude at each of the frequency points with a number of K, wherein a phase of the synthesized frequency domain signal at each of the frequency points with a number of K is a corresponding phase in an original frequency domain signal of a reference device for sound collecting specified in the devices for sound collecting with a number of M; and convert the synthesized frequency domain signal into a synthesized time domain signal, wherein, M, N, and K are integers greater than or equal to 2.

According to a fourth aspect of the embodiments of the present disclosure, there is provided a non-transitory computer readable storage medium, when instructions in the storage medium are executed by a processor of a mobile terminal, enables a mobile terminal to perform a method for sound collecting, the method including:

converting time domain signals with a number of M collected by devices for sound collecting with a number of M into original frequency domain signals with a number of M;

performing beam-forming on the original frequency domain signals with a number of M at each of preset grid points with a number of N, to obtain beam-forming frequency domain signals with a number of N in one-to-one correspondence with the preset grid points with a number of N;

determining an average amplitude of frequency components with a number of N corresponding to each of frequency points with a number of K based on the beam-forming frequency domain signals with a number of N, and synthesizing a synthesized frequency domain signal including the frequency points with a number of K and having the average amplitude as an amplitude at each of the frequency points with a number of K, wherein a phase of the synthesized frequency domain signal at each of the frequency points with a number of K is a corresponding phase in an original frequency domain signal of a reference device for sound collecting specified in the devices for sound collecting with a number of M; and converting the synthesized frequency domain signal into a synthesized time domain signal, wherein, M, N, and K are integers greater than or equal to 2.

It should be understood that both the foregoing general description and the following detailed description are exemplary only and are not restrictive of the present disclosure.

BRIEF DESCRIPTION OF THE DRAWINGS

The accompanying drawings, which are incorporated in and constitute a part of this disclosure, illustrate embodiments consistent with the present disclosure, and together with the specification, serve to explain principles of the present disclosure.

DETAILED DESCRIPTION

Exemplary embodiments will be illustrated in detail here, examples of which are expressed in the accompanying drawings. When the following description refers to accompanying drawings, the same numbers in different drawings represent the same or similar elements unless otherwise indicated. The implementations described in the following exemplary embodiments do not represent all implementations consistent with the disclosure. Instead, they are merely examples of devices and methods consistent with aspects of the disclosure as recited in the appended claims.

Smart devices mostly use a microphone array for sound pickup, and a beam-forming technology of microphone array can be employed to improve a processing quality of voice signals, to improve a speech recognition success rate in real environment. There are two difficulties in the beam-forming technology of microphone array: 1. it is difficult to estimate noise; 2. a direction of a voice under strong interference is unknown. For a direction guiding problem of a voice, a direction guiding algorithm is relatively accurate in a quiet scenario, but in a strong interference scenario, the direction guiding algorithm will be invalid, which is determined by constraints of the direction guiding algorithm itself. Various embodiments of the present disclosure can address the direction guiding problem of voice in the strong interference scenario.

A method for sound collecting according to embodiments of the present disclosure is used in an array of devices for sound collecting. The array of devices for sound collecting is an array of a plurality of devices for sound collecting located at different positions in the space arranged in a regular shape, and is a sort of devices for spatially sampling spatially propagated sound signals, and collected signal contains spatial position information thereof. According to a topology of the devices for sound collecting, the array may be a one-dimensional array, a two-dimensional planar array, or a three-dimensional array, such as a sphere array and the like.

Figure 1:
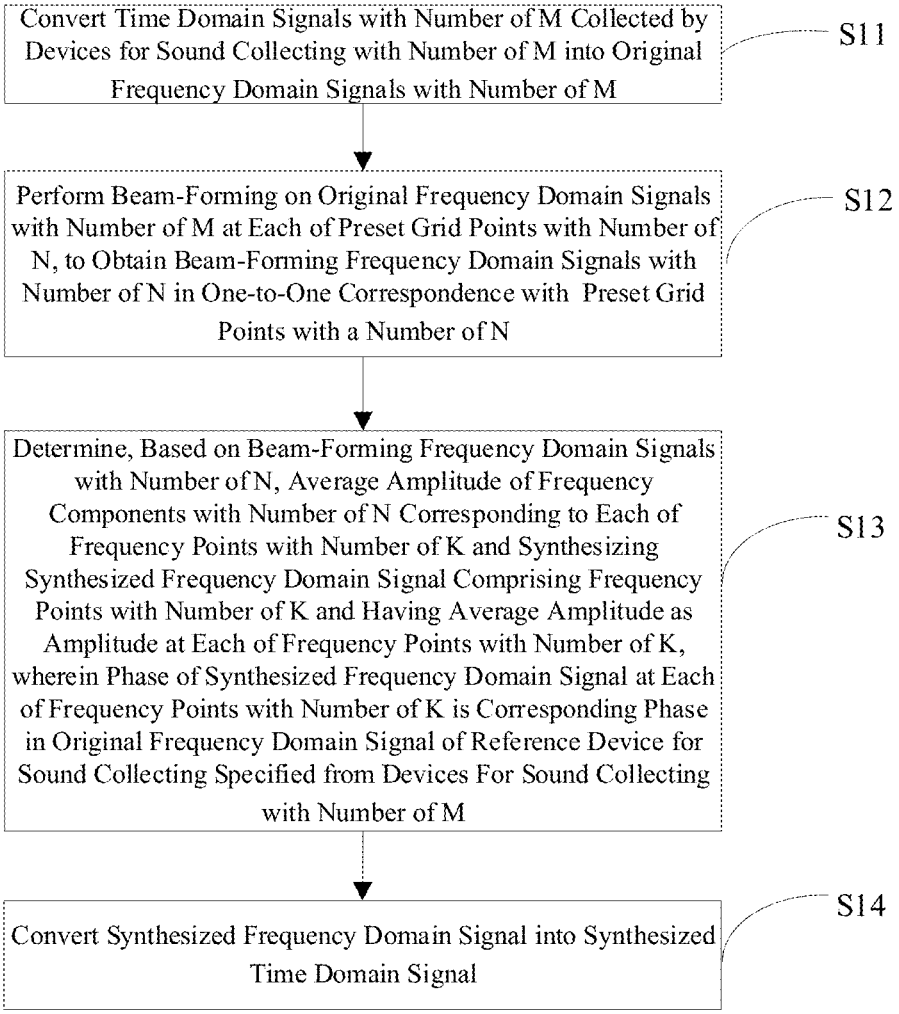
FIG. 1 is a flowchart of a method for sound collecting according to some embodiments.

FIG. 1 is a flowchart of a method for sound collecting according to some embodiments, as shown in FIG. 1, the method for sound collecting of embodiments of the present disclosure includes operations S11-S14.

In operation S11, time domain signals with a number of M collected by devices for sound collecting with a number of M are converted into original frequency domain signals with a number of M, where M is an integer greater than or equal to 2. To implement the method of the present disclosure, it is necessary to use two or more devices for sound collecting to collect sound signals from different directions. The more the number of devices for sound collecting is, the better the effect of suppressing interference is. An arrangement of the devices for sound collecting with a number of M may be a linear array arrangement, a planar array arrangement or any other arrangement as would occur to those skilled in the art.

In one example, $x^m(t)$ represents a framed windowing signal (m=1, 2, . . . M) of the m-th device for sound collecting in the array of devices for sound collecting. After performing Fourier transform on the time domain signal $x^m(t)$, a corresponding original frequency domain signal $X^m(k)$ is obtained. Illustratively, a length of one frame may be set in a range of 10 ms to 30 ms, for example, 20 ms. Then, the windowing process is for signals after framing to be continuous. For example, a Hamming window may be performed on an audio signal when the audio signal is processed.

In operation S12, beam-forming is performed on the original frequency domain signals with a number of M at each of preset grid points with a number of N, to obtain beam-forming frequency domain signals with a number of N in one-to-one correspondence with the preset grid points with a number of N, wherein, N is an integer greater than or equal to 2.

The preset grid points refer to a plurality of points obtained by dividing estimated sound source position or direction into grids in desired collection space, which is performing meshing processing on the desired acquisition space centered on the array of devices for sound collecting (including a plurality of devices for sound collecting). Specifically, a process of meshing processing is: using a geometric center of the array of devices for sound collecting as the center of the grid, and using a certain length from the center of the grid as radius, performing circular meshing in a two-dimensional space or spherical meshing in a three-dimensional space; for another example, using a geometric center of the array of devices for sound collecting as the center of the grid, and using the center of the grid as a square center and a certain length as a side length, performing square meshing in the two-dimensional space, or, using the center of the grid as a square center and a certain length as a side length, performing square meshing in the three-dimensional space.

It should be noted that preset grid points are only virtual points used for beam-forming in the embodiments, and are not real sound source points or sound source collecting points. The larger the value of N, which is the number of preset grid points is, the more directions are selected, the more directions beam-forming may be performed in, and the better a final effect will be. At the same time, preset grid points with a number of N should be distributed in different directions as much as possible for sampling in multiple directions.

In an example, the preset grid points with a number of N are placed in a same plane and distributed in various directions in the plane. Furthermore, for sake of illustration, the preset grid points with a number of N are evenly distributed within 360 degrees, which is convenient for calculation and may achieve better results. It should be noted that arrangement manners of the preset grid points with a number of N of the present disclosure are not limited thereto.

In operation S13, an average amplitude of frequency components with a number of N corresponding to each of frequency points with a number of K is determined based on the beam-forming frequency domain signals with a number of N, and a synthesized frequency domain signal including the frequency points with a number of K and having the average amplitude as an amplitude at each of the frequency points with a number of K is synthesized, where a phase of the synthesized frequency domain signal at each of the frequency points with a number of K is a corresponding phase in an original frequency domain signal of a reference device for sound collecting specified in the devices for sound collecting with a number of M. Here, the reference device for sound collecting is related to the beam-forming process in the above operation S12, specifically a device for sound collecting for determining a reference time delay in the beam-forming process. The beam-forming process will be described in further detail below. In addition, the frequency points with a number of K are related to the original frequency domain signal in operation S11. For example, after sound signals are transformed from a time domain to a frequency domain through Fourier transform, a plurality of frequency points contained therein may be determined according to the frequency domain signals.

In operation S14, the synthesized frequency domain signal is converted into a synthesized time domain signal. The synthesized time domain signal is used as a de-interference enhanced voice signal for subsequent processing of a device for sound collecting, therefore, a purpose of suppressing noise may be achieved.

Next, operation S12 of the method for sound collecting will be described in detail. In an embodiment, operation S12 may include operations S121-S123.

In operation S121, preset grid points with a number of N in different directions are selected within a desired collecting range of the devices for sound collecting with a number of M.

The preset grid points with a number of N should be distributed as much as possible in different directions for sampling in multiple directions. For ease of implementation, the preset grid points with a number of N may be selected in a same plane and distributed in various directions within the plane. Of course, in order to more easily implement the method of the present disclosure, the preset grid points with a number of N may be evenly distributed within 360 degrees.

In operation S122, a steering vector associated with each of the frequency points with a number of K is determined based on a positional relationship between the devices for sound collecting with a number of M and each of the preset grid points with a number of N at the each of the preset grid points with a number of N.

For example, in an example, the operation S122 may be implemented as: taking an origin of a coordinate system of the array of devices for sound collecting with a number of M as a center, coordinates of the devices for sound collecting and the preset grid points with a number of N are determined; the steering vector is established at the each of the frequency points with a number of K for the each of the preset grid points with a number of N based on the coordinates of the devices for sound collecting with a number of M, and the steering vector of preset grid points with a number of N at the each of the frequency points with a number of K is obtained.

In an embodiment, the operation S122 may include following operations.

In operation S1221, a distance vector of the each of the preset grid points with a number of N to the devices for sound collecting with a number of M is obtained.

In operation S1222, a reference delay vector of the each of the preset grid points to the devices for sound collecting with a number of M is determined based on the distance vector of the each of the preset grid points with a number of N to the devices for sound collecting with a number of M and a distance from the each of the preset grid points with a number of N to a reference device for sound collecting.

In operation S1223, a steering vector of the each of the preset grid points with a number of N at the each of the frequency points with a number of K is determined based on the reference delay vector.

In an example, taking a preset grid point as an example, it is assumed that the preset grid point is the n-th preset grid point (n=1, 2 . . . N), for convenience of expression, using $S^n$ to indicate coordinates of the n-th preset grid point, and the coordinate value is $(S_x^n, S_y^n)$. In addition, because there are M devices for sound collecting, there will be M coordinates of devices for sound collecting, respectively, $P^1$, $P^2$ . . . $P^M$. Corresponding coordinate values are: $(P_x^1, P_y^1)$, $(P_x^2, P_y^2)$ . . . $(P_x^M, P_y^M)$, and P represents a coordinate matrix of all the devices for sound collecting:

$$P = \begin{bmatrix} P_x^1 & P_y^1 \\ \vdots & \vdots \\ P_x^M & P_y^M \end{bmatrix}.$$

First, a distance from the preset grid point to the reference device for sound collecting is obtained. As an example, it is assumed here that a first device for sound collecting of the devices for sound collecting with a number of M serves as the reference device for sound collecting. It should be noted that, in fact, any of the devices for sound collecting with a number of M may be specified as the reference device for sound collecting, as long as the reference device for sound collecting remains unchanged during entire execution process of the method for sound collecting. Therefore, in the example, a distance from the preset grid point to the reference device for sound collecting is: $d_1 = \|P^1 - S^n\|_2 = \sqrt{(P_x^1 - S_x^n)^2 + (P_y^1 - S_y^n)^2}$. Then, a distance vector of the preset grid point to the devices for sound collecting with a number of M may be obtained: $dist = P - S^n$, where P is the coordinate matrix representing all the devices for sound collecting above. It should be noted that, in fact, the distance $d_1$ from the preset grid point to the reference device for sound collecting is a value in the distance vector dist of the preset grid point to the devices for sound collecting with a number of M, and therefore, an order between calculation of $d_1$ and dist is not limited.

Based on the distance vector of the preset grid point S″ to the devices for sound collecting with a number of M, a delay vector of the preset grid point S″ to the devices for sound collecting with a number of M is calculated and represented by tau, then tau=sqrt(sum(dist.^2,2)), that is, squares of values of the vector of dist are summed by row and then take a square root of the sum.

A delay from the preset grid point to the reference device for sound collecting is subtracted from the delay vector of the preset grid point to the devices for sound collecting with a number of M, then the result is divided by the speed of sound, a reference delay vector taut maybe obtained: taut=(tau−$tau_1$)/c, where tau is the delay vector of the preset grid point to the devices for sound collecting with a number of M, $tau_1$ is the delay of the preset grid point to a specified reference device for sound collecting, $tau_1=d_1/c$, c is the speed of sound.

By plugging the reference delay vector taut into the steering vector formula: $a_s(k)=e^{-j\times 2\pi k\times \Delta f\times taut}$, the steering vector of the preset grid point at frequency points with a number of K may be obtained, where: e is a natural base, j is an imaginary unit, and K is a number of frequency points obtained by Fourier transform (ranging from 0 to Nfft-1), $\Delta f=f_s/Nfft$, where $f_s$ is an adoption rate, Nfft is a number of points of the Fourier transform, and c is the speed of sound. In the same way, steering vectors of other preset grid points at each frequency point may be obtained, which will not be enumerated here.

Next, in operation S123, beam-forming on the original frequency domain signals with a number of M is performed based on the steering vector on each the of the frequency points with a number of K at the each of the preset grid points with a number of N, and the beam-forming frequency domain signals corresponding to the each of the preset grid points with a number of N are obtained.

In an example, the operation S123 may include operations S1231-S1232.

In operation S1231, a beam-forming weight coefficient corresponding to the each of the frequency points with a number of K is determined based on the steering vector of the each of the frequency points with a number of K and a noise covariance matrix of the each of the frequency points with a number of K:

$$W_{mvdr}(k)=\frac{R_n^{-1}(k)a_s(k)}{a_s^H(k)R_n^{-1}(k)a_s(k)},$$

where $a_s(k)$ is the steering vector of the preset grid point at each of the frequency points, and $R_n(k)$ is the noise covariance matrix of each of the frequency points, which may be a noise covariance matrix estimated by any algorithm, and $R_n^{-1}(k)$ is an inverse of $R_n(k)$, $a_s^H(k)$ is a conjugate transpose of the steering vector.

In operation S1232, the beam-forming frequency domain signals corresponding to the each of the frequency points with a number of K of each of the preset grid points with a number of N are determined based on the beam-forming weight coefficient of the each of the frequency points and the original frequency domain signals with a number of M. Specifically, for one preset grid point, a beam-forming frequency component corresponding to the each of the frequency points may be determined based on the beam-forming weight coefficient of the frequency point and frequency components with a number of M corresponding to the frequency point in the original frequency domain signals with a number of M, then the beam-forming frequency domain signals of the preset grid point are synthesized from the beam-forming frequency components with a number of K.

$$Y_n(k)=W_{mvdr}^H(k)\times X(k),\text{ where,}$$

$$X(k)=\begin{bmatrix} X^1(k) \\ \vdots \\ X^M(k) \end{bmatrix},$$

$W_{mvdr}^H(k)$ is a conjugate transpose of $W_{mvdr}(k)$.

Corresponding to each of the preset grid points, a beam-forming frequency domain signal is obtained; preset grid points with a number of N are selected, and beam-forming frequency domain signals with a number of N may be obtained, which are respectively represented as $Y_1, Y_2, \ldots Y_N$.

In an embodiment, in operation S13, an average amplitude of frequency components with a number of N corresponding to each of frequency points with a number of K is determined based on the beam-forming frequency domain signals with a number of N, and a synthesized frequency domain signal including the frequency points with a number of K and having the average amplitude as an amplitude at each of the frequency points with a number of K is synthesized, where a phase of the synthesized frequency domain signal at each of the frequency points with a number of K is a corresponding phase in an original frequency domain signal of a reference device for sound collecting specified from the devices for sound collecting with a number of M.

In an example, for the obtained beam-forming frequency domain signals with a number of N, $Y_1, Y_2, \ldots Y_N$, an amplitude of frequency components at a certain frequency point may be expressed as $R_1(k), R_2(k), \ldots R_N(k)$, an average amplitude of all beam-forming frequency domain signals with a number of N at the k-th frequency point may be obtained by: $R(k)=(R_1(k)+R_2(k)+\ldots+R_n(k))/N$. Phases of the frequency domain signals collected by the reference device for sound collecting are obtained, referring to the frequency domain signals represented as $X^1(k)$ collected by the reference device for sound collecting, the phase is phase($X^1(k)$). The synthesized frequency domain signal including frequency points with a number of K, having an average amplitude of the corresponding frequency point as an amplitude at each of the frequency points and having the phase of the corresponding frequency point in the original frequency domain signal of the reference device for sound collecting as a phase is synthesized by: $Y_{sum}(k)=R(k)\times e^{j\times phase(X^1(k))}$.

Returning to the operation S14 of the method for sound collecting, in this operation, the synthesized frequency domain signal is subjected to inverse Fourier transform to obtain a synthesized time domain signal: $y(N)=ISTFT(Y_{sum}(k))$. Here, the synthesized time domain signal is an enhanced sound signal after de-interference. By applying the method for sound collecting of embodiments of the present disclosure, noise in interference direction in original time domain signals collected by a microphone array is well suppressed, thereby obtaining enhanced time domain signals.

In an embodiment, in operation S121, the preset grid points with a number of N are evenly arranged on a circle in a horizontal plane of an array coordinate system formed by the devices for sound collecting with a number of M. Illustratively, a radius of the circle may be between about 1 meter and 5 meters. It is easy to calculate and the effect will be relatively good.

In order to better understand technical solutions in the present disclosure, an example is illustrated here.

Figure 2:
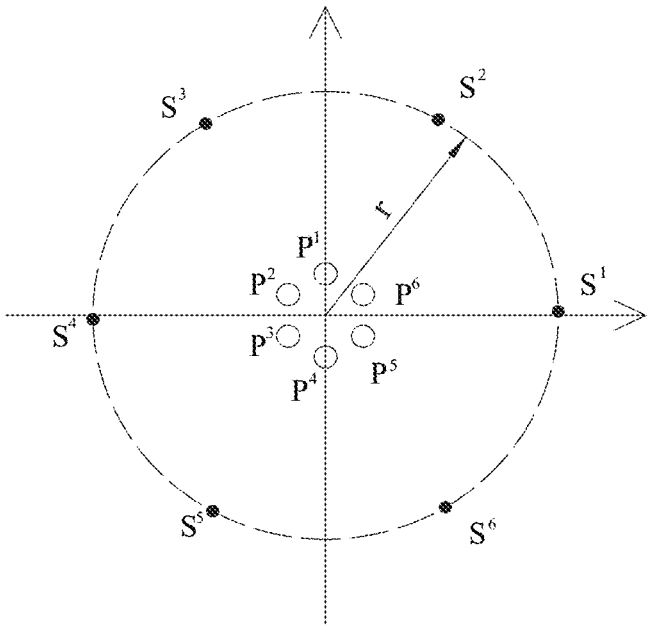
FIG. 2 is a schematic diagram of establishing preset grid points through a method for sound collecting according to some embodiments.

As is shown in FIG. 2, taking a smart speaker as an example, the speaker includes six microphones. Centering on an origin of an array coordinate system of the six microphones, a circle of radius r is selected on the horizontal plane of the array composed of the six microphones. The radius r may be 1~1.5 m, which is a distance between people and smart speakers under normal conditions. Six points at equal intervals in a range of 0°~360° on the circle are selected, for example, points corresponding to 1°, 61°, 121°, 181°, 241°, and 301°, as preset grid points. A device for sound collecting of a position in a 90° direction is specified as the reference device for sound collecting, and in subsequent calculations, the device for sound collecting is always used as the reference device for sound collecting, and of course, other devices for sound collecting may be specified as the reference device for sound collecting.

Then, taking the origin of the array coordinate system as the center, coordinates of the six microphones are obtained, respectively as $P^1$, $P^2$ . . . $P^6$. Corresponding coordinate values are: $(P_x^1,P_y^1)$, $(P_x^2,P_y^2)$ . . . $(P_x^M,P_y^M)$ and P represents a coordinate matrix of all devices for sound collecting:

$$P = \begin{bmatrix} P_x^1 & P_y^1 \\ \vdots & \vdots \\ P_x^M & P_y^M \end{bmatrix}.$$

And coordinates of the six preset grid points are $S^1$, $S^2$ . . . $S^6$.

Take the preset grid point at 61° as an example, the point is the second preset grid point. The coordinate of the point is $S^2$, and the coordinate values are $(S_x^2,S_y^2)$.

First, a distance from the preset grid point to the reference device for sound collecting (illustratively, the first device for sound collecting is taken as an example here) is obtained by: $d_1=\|P^1-S^2\|_2=\sqrt{(P_x^1-S_x^2)^2+(P_y^1-S_y^2)^2}$. Then, the distance vector of the preset grid point $S^2$ to the devices for sound collecting with a number of M may be obtained as: dist=P−$S^2$.

Based on the distance vector of the preset grid point $S^2$ to the devices for sound collecting with a number of M, a delay vector of the preset grid point $S^2$ to the devices for sound collecting with a number of M is calculated and represented by tau, then tau=sqrt(sum(dist.^2,2)) that is, squares of values of the vector of dist are summed by row and then take a square root of the sum.

A delay of the preset grid point $S^2$ to the reference device for sound collecting is subtracted from the delay vector of the preset grid point $S^2$ to the devices for sound collecting with a number of M, then the result is divided by the speed of sound, a reference delay taut maybe obtained: taut=(tau−$tau_1$)/c, where tau is the delay vector of the preset grid point to the devices for sound collecting with a number of M, $tau_1$ is the delay of the preset grid point to a specified reference device for sound collecting, c is the speed of sound.

By plugging the reference delay vector taut into the steering vector formula: $a_s(k)=e^{-j\times 2\pi k\times f\times taut}$, the steering vector of the preset grid point $S^2$ at frequency points with a number of K may be obtained, which may be expressed as $a_{s^2}(k)$, where: e is a natural base, j is an imaginary unit, and K is a number of frequency points obtained by Fourier transform (ranging from 0 to Nfft-1), $\Delta f=f_s/Nfft$, where $f_s$ is an adoption rate, Nfft is a number of points of the Fourier transform, and c is the speed of sound.

Through the above method, steering vectors of other preset grid points at each frequency point may be obtained.

Six time domain signals collected by the six devices for sound collecting are converted into six original frequency domain signals: $X^1(k)$, $X^2(k)$, . . . $X^6(k)$.

Beam-forming on the six original frequency domain signals at each of the six preset grid points is performed.

Still taking the second preset grid point $S^2$ as an example, a beam-forming weight coefficient of the point is calculated:

$$W_{mvdr}(k) = \frac{R_n^{-1}(k)a_s(k)}{a_s^H(k)R_n^{-1}(k)a_s(k)},$$

where $a_{s^2}$ is a steering vector of the second preset grid point at each of the frequency points, and $R_n(k)$ is a noise covariance matrix of each of the frequency points, which may be a noise covariance matrix estimated by any algorithm, and $R_n^{-1}(k)$ is an inverse of $R_n(k)$, $a_s^H(k)$ is a conjugate transpose of the steering vector.

At the second preset grid point $S^2$, beam-forming on original frequency domain signals of the six devices for sound collecting is performed to obtain beam-forming frequency domain signals corresponding to the second preset grid point:

$$Y_{s2} = W_{mvdr-s^2}^H(k) \times X(k), \text{ where,}$$

$$X(k) = \begin{bmatrix} X^1(k) \\ \vdots \\ X^6(k) \end{bmatrix}.$$

For other preset grid points, a total of six beam-forming frequency domain signals may be obtained by using the same method: $Y_1$, $Y_2$, . . . $Y_6$.

Corresponding to the above six beam-forming frequency domain signals, at a certain frequency point, there are six frequency components corresponding to the frequency at the frequency point. Taking a k-th frequency point as an example, at the frequency corresponding to the frequency point, six frequency components are respectively, $R_1$, (k), $R_2(k)$, . . . $R_6(k)$. An average amplitude of the six beam-forming frequency domain signals at the k-th frequency point may be obtained by: $R(k)=(R_1(k)+R_2(k)+ \ldots +R_6(k))/6$.

A phase of a frequency domain signal collected by the reference device for sound collecting is obtained, and the frequency domain signal collected by the reference device for sound collecting is represented as $X^1(k)$, and the phase thereof is phase $(X^1(k))$.

A synthesized frequency domain signal having an average amplitude of the corresponding frequency point as an amplitude at each of the frequency points and having the phase of the original frequency domain signal of the reference device for sound collecting as a phase is synthesized: $Y_{sum}(k)=R(k)\times e^{j\times phase(X^1(k))}$.

The synthesized frequency domain signal is subjected to inverse Fourier transform to obtain a synthesized time domain signal by: $y(6)=ISTFT(Y_{sum}(k))$. The synthesized time domain signal is used as an output signal.

Figure 3:
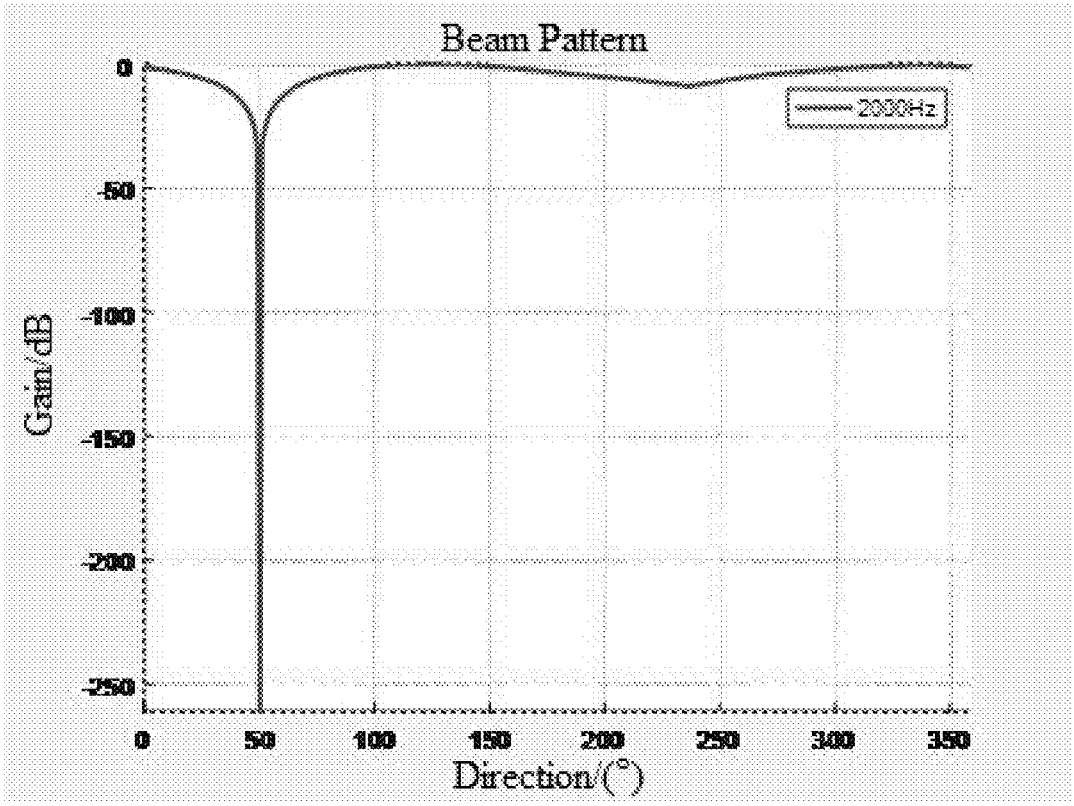
FIG. 3 shows a simulated beam pattern of a microphone array to which a method for sound collecting of embodiments of the present disclosure is applied.

FIG. 3 shows a simulated beam pattern of a microphone array to which a method for sound collecting of embodiments of the present disclosure is applied.

The abscissa in the beam pattern is an orientation of the above preset grid points. During the simulation, an interference source may be set in any orientation. A simulation process and a specific process of drawing the beam pattern are known to those skilled in the art and will not be described in detail herein.

By applying the method for sound collecting of embodiments of the present disclosure, it may be confirmed that the signal gain in the interference direction is the smallest, that is, the interference signal is suppressed, and sound signals in other directions are not largely affected. As is shown in FIG. 3, a deep null is formed in the interference direction, the interference is suppressed, and sound signals in other directions are protected. As may be seen from this embodiment, through the method of the present disclosure, interference in any direction may be suppressed to achieve the purpose of suppressing noise interference.

Figure 4:
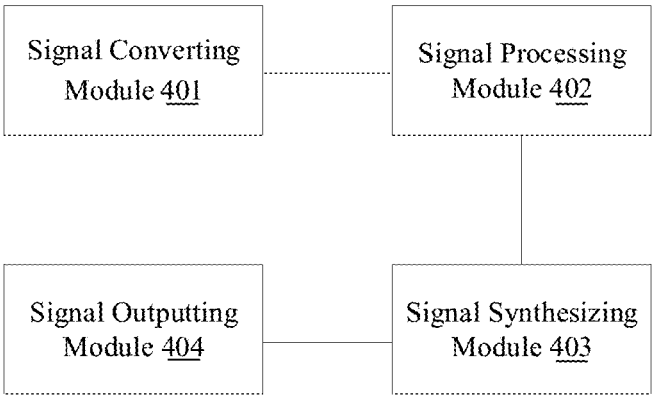
FIG. 4 is a block diagram of a device for sound collecting according to some embodiments.

FIG. 4 is a block diagram of a device for sound collecting according to some embodiments. Referring to FIG. 4, the device includes a signal converting module 401, a signal processing module 402, a signal synthesizing module 403, and a signal outputting module 404.

The various circuits, device components, units, blocks, or portions may have modular configurations, or are composed of discrete components, but nonetheless can be referred to as "units," "modules," or "portions" in general. In other words, the "circuits," "components," "modules," "blocks," "portions," or "units" referred to herein may or may not be in modular forms.

The signal converting module 401 is configured to convert time domain signals with a number of M collected by devices for sound collecting with a number of M into original frequency domain signals with a number of M.

The signal processing module 402 is configured to perform beam-forming on the original frequency domain signals with a number of M at each of preset grid points with a number of N, to obtain beam-forming frequency domain signals with a number of N in one-to-one correspondence with the preset grid points with a number of N.

The signal synthesizing module 403 is configured to determine an average amplitude of frequency components with a number of N corresponding to each of frequency points with a number of K based on the beam-forming frequency domain signals with a number of N, and synthesize a synthesized frequency domain signal including the frequency points with a number of K and having the average amplitude as an amplitude at each of the frequency points with a number of K, where a phase of the synthesized frequency domain signal at each of the frequency points with a number of K is a corresponding phase in an original frequency domain signal of a reference device for sound collecting specified from the devices for sound collecting with a number of M; and the signal outputting module 404 is configured to convert the synthesized frequency domain signal into a synthesized time domain signal, wherein, M, N, and K are integers greater than or equal to 2.

The signal processing module performs the beam-forming on the original frequency domain signals with a number of M at each of the preset grid points with a number of N, to obtain the beam-forming frequency domain signals with a number of N in one-to-one correspondence with the preset grid points with a number of N includes:

selecting preset grid points with a number of N in different directions within a desired collecting range of the devices for sound collecting with a number of M;

determining a steering vector associated with each of the frequency points with a number of K based on a positional relationship between the devices for sound collecting with a number of M and each of the preset grid points with a number of N at the each of the preset grid points with a number of N; and performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N.

The signal processing module determines a steering vector associated with the each of the frequency points with a number of K based on the positional relationship between devices for sound collecting with a number of M and the each of the preset grid points with a number of N at the each of the preset grid points with a number of N includes:

obtaining a distance vector of the each of the preset grid points with a number of N to the devices for sound collecting with a number of M;

determining a reference delay vector of the each of the preset grid points with a number of N to the devices for sound collecting with a number of M based on the distance vector of the each of the preset grid points with a number of N to the devices for sound collecting with a number of M and a distance from the each of the preset grid points with a number of N to a reference device for sound collecting; and determining the steering vector of the each of the preset grid points with a number of N at the each of the frequency points with a number of K based on the reference delay vector.

Performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N includes:

determining a beam-forming weight coefficient corresponding to the each of the frequency points with a number of K based on the steering vector of the each of the frequency points with a number of K and a noise covariance matrix of the each of the frequency points with a number of K; and determining the beam-forming frequency domain signals corresponding to the each of the preset grid points with a number of N, based on the beam-forming weight coefficient and the original frequency domain signals with a number of M.

The preset grid points with a number of N are evenly arranged on a circle in a horizontal plane of an array coordinate system formed by the devices for sound collecting with a number of M.

With regard to the device in above embodiments, specific manners in which respective modules perform operations has been described in detail in the embodiments relating to the method, and will not be explained in detail herein.

Figure 5:
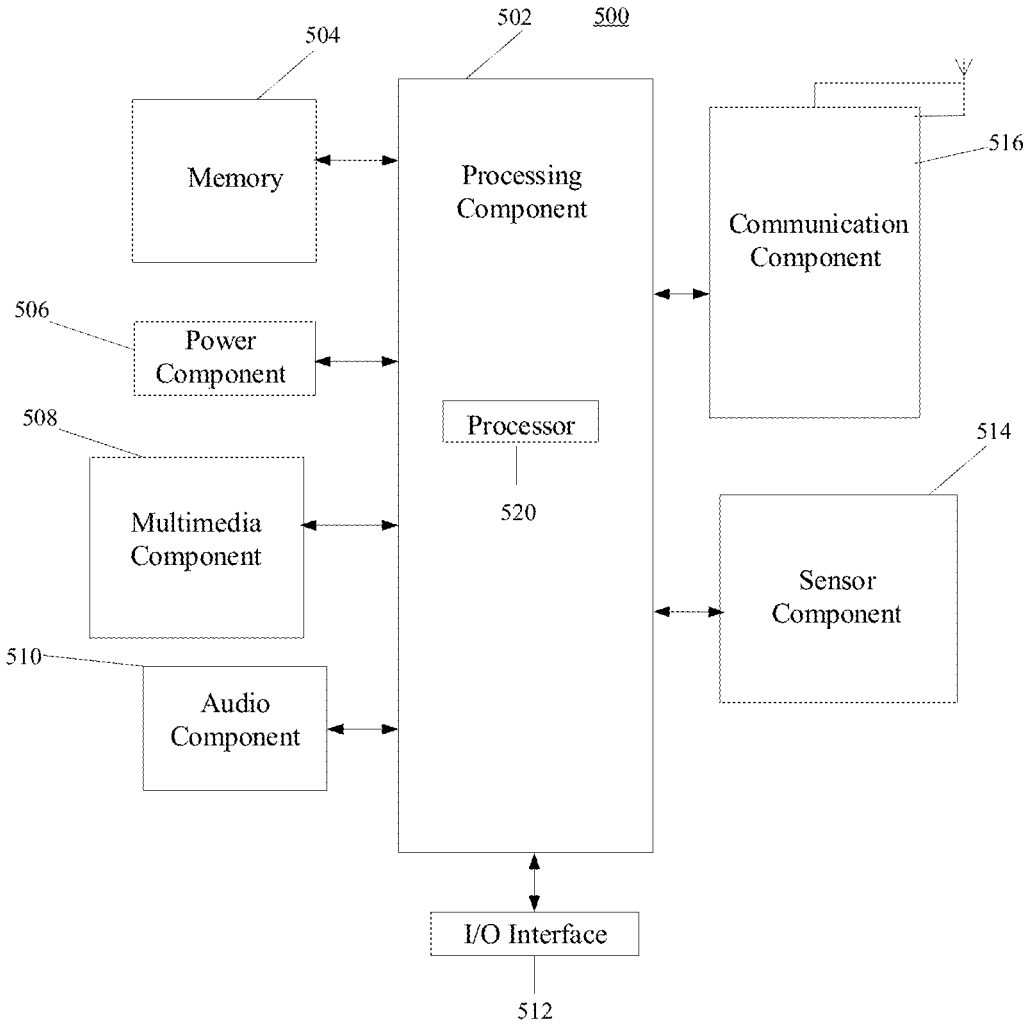
FIG. 5 is a block diagram of a device according to some embodiments.

FIG. 5 is a block diagram of device 500 according to some embodiments. For example, a terminal device 500 may be a mobile phone, a computer, a digital broadcast terminal, a messaging device, a game console, a tablet device, a medical device, a fitness device, a personal digital assistant, and the like.

Referring to FIG. 5, the terminal device 500 may include one or more of following components: a processing component 502, a memory 504, a power component 506, a multimedia component 508, an audio component 510, an Input/Output (I/O) interface 512, a sensor component 514 and a communication component 516.

The processing component 502 typically controls an overall operation of the terminal device 500, such as operation associated with display, telephone calls, data communications, camera operations and recording operations. The processing component 502 may include one or more processors 520 to execute instructions to perform all or part of the operations of the methods described above. Moreover, the processing component 502 may include one or more modules to facilitate interactions between the processing component 502 and other components. For example, the processing component 502 may include a multimedia module to facilitate interactions between the multimedia component 508 and the processing component 502.

The memory 504 is configured to store various types of data to support operations on the terminal device 500. Examples of such data include instructions of any application or method operated on the terminal device 500, contact data, phone book data, messages, pictures, videos, and the like. The memory 504 may be implemented by any type of volatile or non-volatile storage devices, or a combination thereof, which may be such as a Static Random Access Memory (SRAM), an Electrically Erasable Programmable Read Only Memory (EEPROM), an Erasable Programmable Read Only Memory (EPROM), a Programmable Read Only Memory (PROM), a Read Only Memory (ROM), a magnetic memory, a flash memory, a disk or an optical disk.

The power component 506 supplies power to various components of the terminal device 500. The power component 506 may include a power management system, one or more power sources, and other components associated with generating, managing, and distributing power for the terminal device 500.

The multimedia component 508 includes a screen that provides an output interface between the terminal device 500 and a user. In some embodiments, the screen may include a Liquid Crystal Display (LCD) and a Touch Panel (TP). In some embodiments, an organic light-emitting diode (OLED) display or other types of display screens can be adopted.

If the screen includes a touch panel, the screen may be implemented as a touch screen to receive input signals from the user. The touch panel includes one or more touch sensors to sense touches, slides, and gestures on the touch panel. The touch sensor may not only sense boundaries of touch or sliding actions, but also detect durations and pressures associated with touch or slide operations. In some embodiments, the multimedia component 508 includes a front camera and/or a rear camera. When the terminal device 500 is in an operation mode, such as a shooting mode or a video mode, the front camera and/or the rear camera may receive external multimedia data. Each front camera and each rear camera may be a fixed optical lens system or have focal length and optical zoom capability.

The audio component 510 is configured to output and/or input audio signals. For example, the audio component 510 includes a microphone (MIC), and when the terminal device 500 is in an operational mode, such as a call mode, a recording mode, or a voice recognition mode, the microphone is configured to receive external audio signals. The received audio signal may be further stored in the memory 504 or sent through the communication component 516. In some embodiments, the audio component 510 further includes a speaker for outputting audio signals.

The I/O interface 512 provides an interface between the processing component 502 and a peripheral interface module. The peripheral interface module may be a keyboard, a click wheel, a button, and the like. These buttons may include, but are not limited to, a home button, a volume button, a start button and a lock button.

The sensor assembly 514 includes one or more sensors for providing a status assessment of various aspects for the terminal device 500. For example, the sensor component 514 may detect an on/off state of the terminal device 500 and a relative positioning of components, such as a display and keypad of the terminal device 500; the sensor component 514 may further detect a position change of the terminal device 500 or one component of the terminal device 500, a presence or absence of contact of the user with the terminal device 500, azimuth or acceleration/deceleration of the terminal device 500, and temperature changes of the terminal device 500. The sensor component 514 may include a proximity sensor, configured to detect a presence of nearby objects without any physical contact. The sensor component 514 may further include a light sensor, such as a CMOS or CCD image sensor, for use in imaging applications. In some embodiments, the sensor component 514 may further include an acceleration sensor, a gyro sensor, a magnetic sensor, a pressure sensor, or a temperature sensor.

The communication component 516 is configured to facilitate wired or wireless communication between the terminal device 500 and other devices. The terminal device 500 may access a wireless network based on a communication standard such as Wi-Fi, 2G, 3G, 4G, or 5G, or a combination thereof. In some embodiments, the communication component 516 receives broadcast signals or information about broadcast from an external broadcast management system through broadcast channels. In some embodiments, the communication component 516 further includes a Near Field Communication (NFC) module to facilitate short range communication. For example, the NFC module may be implemented based on Radio Frequency IDentification (RFID) technology, Infrared Data Association (IrDA) technology, Ultra-WideBand (UWB) technology, BlueTooth (BT) technology and other technologies.

In some embodiments, the terminal device 500 may be implemented by one or more Application Specific Integrated Circuits (ASICs), Digital Signal Processors (DSP), Digital Signal Processing Devices (DSPD), Programmable Logic Devices (PLD), Field Programmable Gate Arrays (FPGA), controllers, microcontrollers, microprocessors, or other electronic components, for performing the methods described above.

In some embodiments, there is further provided a non-transitory computer readable storage medium including instructions, such as the memory 504 including instructions and the instructions may be executed by the processor 520 of the terminal device 500 to perform the above method. For example, the non-transitory computer readable storage medium may be a ROM, a Random-Access Memory (RAM), a CD-ROM, a magnetic tape, a floppy disk, an optical data storage device, and the like.

A non-transitory computer readable storage medium, when instructions in the storage medium are executed by a processor of a mobile terminal, the mobile terminal is enabled to perform a method for sound collecting, and the method includes:

converting time domain signals with a number of M collected by devices for sound collecting with a number of M into original frequency domain signals with a number of M;

performing beam-forming on the original frequency domain signals with a number of M at each of preset grid points with a number of N, to obtain beam-forming frequency domain signals with a number of N in one-to-one correspondence with the preset grid points with a number of N;

determining an average amplitude of frequency components with a number of N corresponding to each of frequency points with a number of K based on the beam-forming frequency domain signals with a number of N, and synthesizing a synthesized frequency domain signal including the frequency points with a number of K and having the average amplitude as an amplitude at each of the frequency points with a number of K, where a phase of the synthesized frequency domain signal at each of the frequency points with a number of K is a corresponding phase in an original frequency domain signal of a reference device for sound collecting specified in the devices for sound collecting with a number of M; and converting the synthesized frequency domain signal into a synthesized time domain signal, where M, N, and K are integers greater than or equal to 2.

Various embodiments of the disclosure can have one or more of the following advantages.

A multi-directional beam-forming strategy is used to sum multi-directional beams, to achieve the effect of the beam pattern forming a null trap in an interference direction and normal outputs in other directions, subtly bypassing the problem that inaccurate direction guiding algorithm under strong interference results in poor sound collecting effect or inaccurate sound collecting.

Those of ordinary skill in the art will understand that the above described modules/units can each be implemented by hardware, or software, or a combination of hardware and software. Those of ordinary skill in the art will also understand that multiple ones of the above described modules/units may be combined as one module/unit, and each of the above described modules/units may be further divided into a plurality of sub-modules/sub-units.

In the present disclosure, it is to be understood that the terms "lower," "upper," "center," "longitudinal," "transverse," "length," "width," "thickness," "upper," "lower," "front," "back," "left," "right," "vertical," "horizontal," "top," "bottom," "inside," "outside," "clockwise," "counter-clockwise," "axial," "radial," "circumferential," "column," "row," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, the terms "installed," "connected," "coupled," "fixed" and the like shall be understood broadly, and may be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the present disclosure, a first element being "on," "over," or "below" a second element may indicate direct contact between the first and second elements, without contact, or indirect through an intermediate medium, unless otherwise explicitly stated and defined.

Moreover, a first element being "above," "over," or "at an upper surface of" a second element may indicate that the first element is directly above the second element, or merely that the first element is at a level higher than the second element. The first element "below," "underneath," or "at a lower surface of" the second element may indicate that the first element is directly below the second element, or merely that the first element is at a level lower than the second feature. The first and second elements may or may not be in contact with each other.

In the description of the present disclosure, the terms "one embodiment," "some embodiments," "example," "specific example," or "some examples," and the like may indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described may be combined in a suitable manner in any one or more embodiments or examples. In addition, various embodiments or examples described in the specification, as well as features of various embodiments or examples, may be combined and reorganized.

In some embodiments, the control and/or interface software or app can be provided in a form of a non-transitory computer-readable storage medium having instructions stored thereon is further provided. For example, the non-transitory computer-readable storage medium may be a Read-Only Memory (ROM), a Random-Access Memory (RAM), a Compact Disc Read-Only Memory (CD-ROM), a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more modules of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium may be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures. For example, the devices can be controlled remotely through the Internet, on a smart phone, a tablet computer or other types of computers, with a web-based graphic user interface (GUI).

A computer program (also known as a program, software, software application, app, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a mark-up language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode) display, other flexible configuration, or any other monitor for displaying information to the user and a keyboard, a pointing device, e.g., a mouse, trackball, etc., or a touch screen, touch pad, etc., by which the user can provide input to the computer.

Other types of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In an example, a user can speak commands to the audio processing device, to perform various operations.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombinations.

Moreover, although features may be described above as acting in certain combinations and even initially claimed as such, one or more features from a claimed combination can in some cases be excised from the combination, and the claimed combination may be directed to a subcombination or variations of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A method for sound collection, comprising:

converting time domain signals with a number of M collected by devices for sound collecting with a number of M into original frequency domain signals with a number of M;

performing beam-forming on the original frequency domain signals with a number of M at each of preset grid points with a number of N, to obtain beam-forming frequency domain signals with a number of N in one-to-one correspondence with the preset grid points with a number of N;

determining, based on the beam-forming frequency domain signals with a number of N, an average amplitude of frequency components with a number of N corresponding to each of frequency points with a number of K and synthesizing a synthesized frequency domain signal comprising the frequency points with a number of K and having the average amplitude as an amplitude at each of the frequency points with a number of K, wherein a phase of the synthesized frequency domain signal at each of the frequency points with a number of K is a corresponding phase in an original frequency domain signal of a reference device for sound collecting specified from the devices for sound collecting with a number of M; and converting the synthesized frequency domain signal into a synthesized time domain signal, wherein M, N, and K are integers greater than or equal to 2; and wherein any of the devices for sound collecting with a number of M is configurable as the reference device.

2. The method according to claim 1, wherein the performing beam-forming on the original frequency domain signals with a number of M at each of the preset grid points with a number of N, to obtain the beam-forming frequency domain signals with a number of N in one-to-one correspondence with the preset grid points with a number of N comprises:

selecting preset grid points with a number of N in different directions within a desired collecting range of the devices for sound collecting with a number of M;

determining a steering vector associated with each of the frequency points with a number of K based on a positional relationship between the devices for sound collecting with a number of M and each of the preset grid points with a number of N at the each of the preset grid points with a number of N; and performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N.

3. The method according to claim 2, wherein the determining the steering vector associated with the each of the frequency points with a number of K based on the positional relationship between the devices for sound collecting with a number of M and the each of the preset grid points with a number of N at the each of the preset grid points with a number of N comprises:

obtaining a distance vector of the each of the preset grid points with a number of N to the devices for sound collecting with a number of M;

determining a reference delay vector of the each of the preset grid points to the devices for sound collecting with a number of M based on the distance vector of the each of the preset grid points with a number of N to the devices for sound collecting with a number of M and a distance from the each of the preset grid points with a number of N to a reference device for sound collecting; and determining the steering vector of the each of the preset grid points with a number of N at the each of the frequency points with a number of K based on the reference delay vector.

4. The method according to claim 2, wherein, performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N comprises:

determining a beam-forming weight coefficient corresponding to the each of the frequency points with a number of K based on the steering vector of the each of the frequency points with a number of K and a noise covariance matrix of the each of the frequency points with a number of K; and determining the beam-forming frequency domain signals corresponding to the each of the preset grid points with a number of N, based on the beam-forming weight coefficient and the original frequency domain signals with a number of M.

5. The method according to claim 1, wherein the preset grid points with a number of N are evenly arranged on a circle in a horizontal plane of an array coordinate system formed by the devices for sound collecting with a number of M.

6. A device for sound collection, comprising:

a processor; and memory configured to store processor-executable instructions, wherein the processor is configured to:

convert time domain signals with a number of M collected by devices for sound collecting with a number of M into original frequency domain signals with a number of M;

perform beam-forming on the original frequency domain signals with a number of M at each of preset grid points with a number of N, to obtain beam-forming frequency domain signals with a number of N in one-to-one correspondence with the preset grid points with a number of N;

determine, based on the beam-forming frequency domain signals with a number of N, an average amplitude of frequency components with a number of N corresponding to each of frequency points with a number of K and synthesizing a synthesized frequency domain signal comprising the frequency points with a number of K and having the average amplitude as an amplitude at each of the frequency points with a number of K, wherein a phase of the synthesized frequency domain signal at each of the frequency points with a number of K is a corresponding phase in an original frequency domain signal of a reference device for sound collecting specified from the devices for sound collecting with a number of M; and convert the synthesized frequency domain signal into a synthesized time domain signal, wherein, M, N, and K are integers greater than or equal to 2;

wherein any of the devices for sound collecting with a number of M is configurable as the reference device.

7. The device according to claim 6, wherein, the processor performs beam-forming on the original frequency domain signals with a number of M at each of the preset grid points with a number of N, to obtain the beam-forming frequency domain signals with a number of N in one-to-one correspondence with the preset grid points with a number of N comprises:

selecting preset grid points with a number of N in different directions within a desired collecting range of the devices for sound collecting with a number of M;

determining a steering vector associated with each of the frequency points with a number of K based on a positional relationship between the devices for sound collecting with a number of M and each of the preset grid points with a number of N at the each of the preset grid points with a number of N; and performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N.

8. The device according to claim 7, wherein the determining the steering vector associated with the each of the frequency points with a number of K based on the positional relationship between the devices for sound collecting with a number of M and the each of the preset grid points with a number of N at the each of the preset grid points with a number of N comprises:

obtaining a distance vector of the each of the preset grid points with a number of N to the devices for sound collecting with a number of M;

determining a reference delay vector of the each of the preset grid points to the devices for sound collecting with a number of M based on the distance vector of the each of the preset grid points with a number of N to the devices for sound collecting with a number of M and a distance from the each of the preset grid points with a number of N to a reference device for sound collecting; and determining the steering vector of the each of the preset grid points with a number of N at the each of the frequency points with a number of K based on the reference delay vector.

9. The device according to claim 7, wherein the performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N comprises:

determining a beam-forming weight coefficient corresponding to the each of the frequency points with a number of K based on the steering vector of the each of the frequency points with a number of K and a noise covariance matrix of the each of the frequency points with a number of K; and determining the beam-forming frequency domain signals corresponding to the each of the preset grid points with a number of N, based on the beam-forming weight coefficient and the original frequency domain signals with a number of M.

10. The device according to claim 6, wherein the preset grid points with a number of N are evenly arranged on a circle in a horizontal plane of an array coordinate system formed by the devices for sound collecting with a number of M.

11. A non-transitory computer readable storage medium, when instructions in the storage medium are executed by a processor of a mobile terminal, enables a mobile terminal to perform a method for sound collection, the method comprising:

converting time domain signals with a number of M collected by devices for sound collecting with a number of M into original frequency domain signals with a number of M;

performing beam-forming on the original frequency domain signals with a number of M at each of preset grid points with a number of N, to obtain beam-forming frequency domain signals with a number of N in one-to-one correspondence with the preset grid points with a number of N;

determining, based on the beam-forming frequency domain signals with a number of N, an average amplitude of frequency components with a number of N corresponding to each of frequency points with a number of K and synthesizing a synthesized frequency domain signal comprising the frequency points with a number of K and having the average amplitude as an amplitude at each of the frequency points with a number of K, wherein a phase of the synthesized frequency domain signal at each of the frequency points with a number of K is a corresponding phase in an original frequency domain signal of a reference device for sound collecting specified from the devices for sound collecting with a number of M; and converting the synthesized frequency domain signal into a synthesized time domain signal, wherein, M, N, and K are integers greater than or equal to 2;

wherein any of the devices for sound collecting with a number of M is configurable as the reference device.

12. The medium according to claim 11, wherein the performing beam-forming on the original frequency domain signals with a number of M at each of the preset grid points with a number of N, to obtain the beam-forming frequency domain signals with a number of N in one-to-one correspondence with the preset grid points with a number of N comprises:

selecting preset grid points with a number of N in different directions within a desired collecting range of the devices for sound collecting with a number of M;

determining a steering vector associated with each of the frequency points with a number of K based on a positional relationship between the devices for sound collecting with a number of M and each of the preset grid points with a number of N at the each of the preset grid points with a number of N; and performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N.

13. The medium according to claim 12, wherein the determining the steering vector associated with the each of the frequency points with a number of K based on the positional relationship between the devices for sound collecting with a number of M and the each of the preset grid points with a number of N at the each of the preset grid points with a number of N comprises:

obtaining a distance vector of the each of the preset grid points with a number of N to the devices for sound collecting with a number of M;

determining a reference delay vector of the each of the preset grid points to the devices for sound collecting with a number of M based on the distance vector of the each of the preset grid points with a number of N to the devices for sound collecting with a number of M and a distance from the each of the preset grid points with a number of N to a reference device for sound collecting; and determining the steering vector of the each of the preset grid points with a number of N at the each of the frequency points with a number of K based on the reference delay vector.

14. The medium according to claim 12, wherein the performing beam-forming on the original frequency domain signals with a number of M based on the steering vector on the each of the frequency points with a number of K at the each of the preset grid points with a number of N, and obtaining the beam-forming frequency domain signals corresponding to the each of the preset grid points with a number of N comprises:

determining a beam-forming weight coefficient corresponding to the each of the frequency points with a number of K based on the steering vector of the each of the frequency points with a number of K and a noise covariance matrix of the each of the frequency points with a number of K; and determining the beam-forming frequency domain signals corresponding to the each of the preset grid points with a number of N, based on the beam-forming weight coefficient and the original frequency domain signals with a number of M.

15. The medium according to claim 11, wherein the preset grid points with a number of N are evenly arranged on a circle in a horizontal plane of an array coordinate system formed by the devices for sound collecting with a number of M.

16. A smart apparatus implementing the method according to claim 1, comprising a plurality of microphones.

17. The smart apparatus according to claim 16, wherein the smart apparatus is configured to adopt a multi-directional beam-forming strategy by summing multi-directional beams, to achieve an effect of a beam pattern forming a null trap in an interference direction and normal outputs in other directions.

18. The smart apparatus according to claim 17, further comprising one or more speakers.

19. The smart apparatus according to claim 18, further comprising a liquid-crystal display (LCD) or an organic light-emitting diode (OLED) display.

20. The smart apparatus according to claim 19, wherein the smart apparatus comprises a mobile phone.

* * * * *